United States Patent [19]

Röck

[11] Patent Number: 4,937,915

[45] Date of Patent: Jul. 3, 1990

[54] HINGE

[75] Inventor: Erich Röck, Höchst, Austria

[73] Assignee: Julius Blum Gesellshaft m.b.H., Höchst, Australia

[21] Appl. No.: 329,381

[22] Filed: Mar. 27, 1989

[30] Foreign Application Priority Data

Apr. 15, 1988 [AU] Australia ..... 974/88

[51] Int. Cl.[5] ..... E05D 7/04

[52] U.S. Cl. ..... 16/238; 16/DIG. 43

[58] Field of Search ..... 16/236, 237, 238, DIG. 43

[56] References Cited

FOREIGN PATENT DOCUMENTS 3538888 5/1987 Fed. Rep. of Germany .... 16/DIG. 43

*Primary Examiner*—Nicholas P. Godici
*Assistant Examiner*—Carmine Cuda
*Attorney, Agent, or Firm*—Wenderoth, Lind & Ponack

[57] ABSTRACT

A hinge has a hinge arm of U-shaped cross-section connected with a hinge casing by hinge links. The hinge arm is mounted on a mounting plate and at its rear end is pivotally connected thereto. At its fron end, the hinge arm has a female thread into which is screwed a joint adjustment screw which is mounted with its head in a slot of the mounting plate. The slot is open towards the front of the mounting plate. The hinge arm is deformable. The hinge arm and the mounting plate have openings for a screwdriver. The mounting plate has a slot into which extends a pin projecting from a lateral flange of the hinge arm.

3 Claims, 1 Drawing Sheet

HINGE

FIELD AND BACKGROUND OF THE INVENTION

The invention relates to a hinge with a hinge arm of U-shaped cross-section including two lateral flanges and a center flange and connected with a hinge casing by means of hinge links. The hinge arm is mounted on a mounting plate and at its rear end is pivotally connected thereto. At its front end the hinge arm has a female thread into which is screwed a joint adjusting screw which is mounted with its head in a slot of the mounting plates, such slot being open towards the front.

According to the state of the art, hinges are generally mounted in such a way that the hinge casing is fitted into a bore of a door, and the hinge casing is connected with the hinge arm by means of hinge links. The mounting plate is fastened to a furniture side wall separately. When the door is being mounted, the hinge arm is placed on the mounting plate and fastened thereto by means of a clamping screw (see for example AT-PS 296 812). The clamping screw generally also serves for the depth adjustment of the hinge arm, and a joint adjustment screw is provided in most cases.

Furthermore, a hinge is known in which the hinge arm is inserted into groove-like guide means of the mounting plate and the depth adjustment is carried out by bending the hinge arm (AT-PS 353 130).

Moreover, hinges are known in which the mounting plate is pivotally connected to the rear end of the hinge arm, and the mounting plate and the hinge arm are together fastened to the furniture side wall when the door is being mounted. These hinges only provide the possibility of a joint adjustment which is carried out by means of a joint adjustment screw which is mounted in a female thread of the hinge arm and held with a head in a slot of the mounting plate. The slot is open towards the front, i.e. towards the hinge axles.

SUMMARY OF THE INVENTION

It is the object of the invention to provide an improved hinge of the afore-mentioned type wherein depth adjustment is possible in a simple manner.

It should further be ensured that bending of the hinge arm does not cause complete distortion thereof.

According to the invention this is achieved by providing the deformable hinge arm and the mounting plate with an opening for a screwdriver or the like, and by providing the mounting plate with a slot which extends in the longitudinal direction of the mounting plate and into which extends a pin projecting from a lateral flange of the hinge arm.

It is advantageously provided that the hinge arm has at its rear a covering flange connecting the two lateral flanges and the center flange. Two flaps project from the lower rim or edge of the covering flange and extend through another slot in the mounting plate.

An embodiment of the invention provides that the slot into which the pin from the lateral flange extends is arranged beside the covering flange, i.e. adjacent the rear edge of such lateral flange.

BRIEF DESCRIPTION OF THE DRAWINGS

In the following an embodiment of the invention will be described in more detail with reference to the accompanying drawing, in which.

DESCRIPTION OF THE PREFERRED EMBODIMENT

Figure 1:
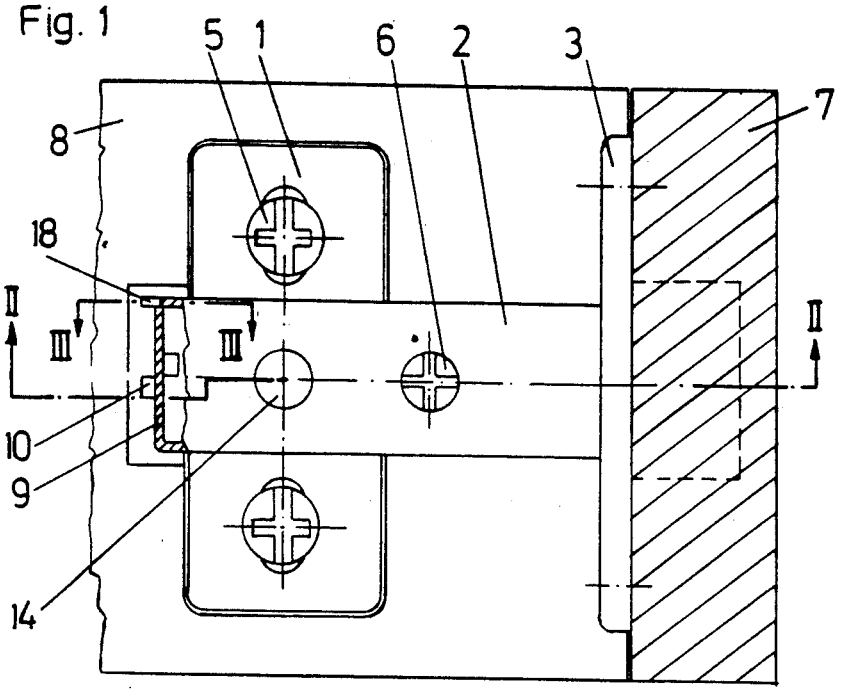
FIG. 1 is a diagrammatic top view of a hinge according to the invention, shown in the closed position thereof and with parts in section.

The basic parts of a hinge are a mounting plate 1, a hinge arm 2 and a hinge casing 3. The hinge arm 2 and the hinge casing 3 are connected by hinge links which are not shown. The hinge arm 2 is made of bendable material, preferably sheet steel.

The hinge casing 3 is fitted into a door 7. The mounting plate 1 is fastened to a furniture side wall 8 by means of screws 5. The screws 5 extend in this arrangement through oblong holes to allow a height adjustment of the hinges.

The rear end of the hinge arm 2, which has a U-shaped cross-section, is provided with a covering flange 9 as a result of which the hinge arm 2 has a box-like shape. Flaps 10 which project into opposite directions are provided in the center of the lower rim or edge of the covering flange 9. Flaps 10 extend through a slot 11 in the mounting plate so that the hinge arm 2 is pivotally connected with the mounting plate 1.

At its front the hinge arm 2 has a female thread 12 in which is mounted a joint adjustment screw 6 which has a abuts with its head 6' on the mounting plate 1. The joint adjustment screw 6 projects through a slot 13 in the mounting plate. The slot 13 is open towards the front of the mounting plate 1.

The term "front" as employed herein means that end of the hinge arm 2 or mounting plate which is directed towards the pivot axis of the hinge, while the term "rear" relates to the end which is remote from such pivot axis.

Figure 2:
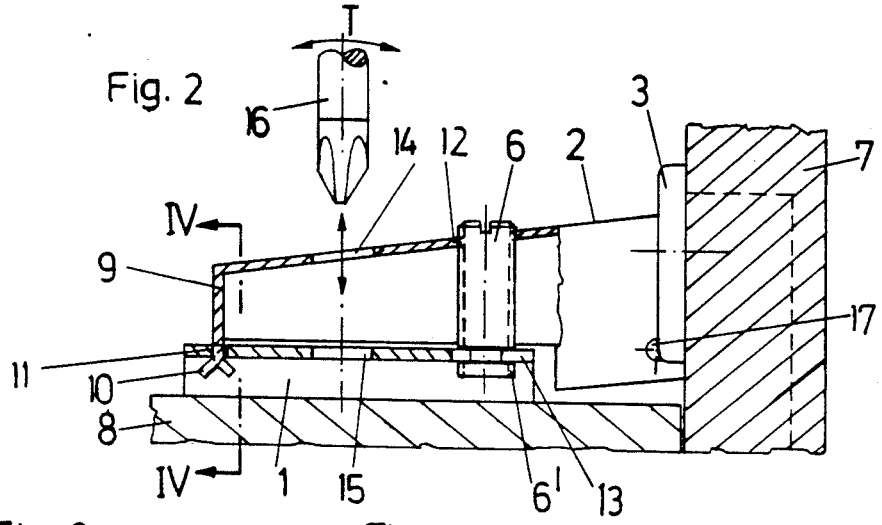
FIG. 2 is a sectional view along line II-II of FIG. 1.
Figure 3:
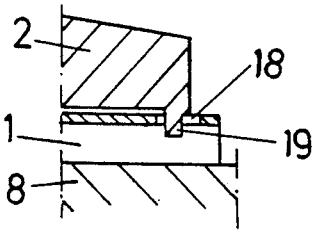
FIG. 3 is a sectional view along line III-III of FIG. 1.
Figure 4:
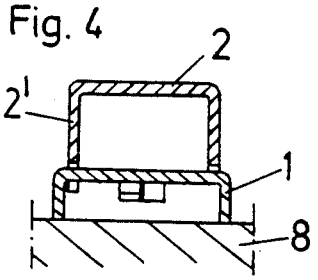
FIG. 4 is a sectional view of a hinge arm along line IV-IV of FIG. 2.

As can particularly be seen in FIG. 2, the hinge arm 2 is provided with an opening 14 and the mounting plate 1 with an opening 15.

The two openings 14 and 15 are provided to receive a tool, e.g. screwdriver 16. When the tip of the screwdriver 16 has been inserted into the opening 15, the hinge arm 2 and mounting axles 17 for the hinge links can be adjusted in the direction of the depth of the article of furniture by displacing the screwdriver 16 in the directions of double arrow T.

To provide some degree of guidance of the hinge arm 2 which is obviously deformed during the course of this adjusting operation, a slot 18 is provided in the mounting plate 1. A pin 19 projects from a lateral flange 2' of the hinge arm 2 and extends into slot 18. The length of slot 18 defines the dimension of the depth adjustment which is set for the hinge arm 2.

The pin 19 prevents the hinge arm 2 from being excessively deformed by the depth adjustment operation and the hinge axles 17 from being moved into a position oblique to the pivot axis of the door 7.

What is claimed is:

1. In a hinge including a mounting plate having in a front end thereof an open-ended first slot, a deformable hinge arm having a U-shaped cross-sectional configuration including two lateral flanges and a center flange, a hinge casing connected by hinge links to said hinge arm, said hinge arm being mounted on said mounting plate and having a rear end pivotally connected thereto, said hinge arm having a front end having therein a female thread, and a joint adjustment screw threaded into said female thread and having a head slidably fitted within said first slot of said mounting plate, the improvement comprising:

said hinge arm and said mounting plate being provided with openings for the insertion therethrough of a tool;

said mounting plate having therein a second slot extending in the longitudinal direction of said mounting plate;

a pin projecting from one of said lateral flanges of said hinge arm and extending into said second slot of said mounting plate;

said hinge arm having at said rear end a covering flange connecting said lateral flanges and said center flange;

said mounting plate having therein a third slot; and said covering flange having projecting from an edge thereof at least one flap extending through said third slot in said mounting plate.

2. The improvement claimed in claim 1, comprising two said flaps extending through said third slot.

3. The improvement claimed in claim 2, wherein said two flaps are bent in opposite directions.

* * * * *

UNITED STATES PATENT AND TRADEMARK OFFICE

CERTIFICATE OF CORRECTION

PATENT NO. : 4,937,915

DATED : July 3, 1990

INVENTOR(S) : Erich Rock

It is certified that error appears in the above-identified patent and that said Letters Patent is hereby corrected as shown below:

On Title page, Item [73] "Assignee", line 2 thereof, change from "Höchst, Australia" to --Höchst, Austria--;

On the Title page, Item[30]"Foreign Application Priority Data", change "[AU] Australia" to --[AT] Austria--.

Signed and Sealed this

Twenty-ninth Day of December, 1992

*Attest:*

DOUGLAS B. COMER

*Attesting Officer*

*Acting Commissioner of Patents and Trademarks*